US009243857B2

(12) United States Patent
Mills et al.

(10) Patent No.: US 9,243,857 B2
(45) Date of Patent: Jan. 26, 2016

(54) FIREARM PIN

(71) Applicant: LANNING RESEARCH LLC, Charlotte, NC (US)

(72) Inventors: Matthew E. Mills, Charlotte, NC (US); Justin L. Lanning, Waxhaw, NC (US)

(73) Assignee: Lanning Research LLC, Charlotte, NC (US)

( * ) Notice: Subject to any disclaimer, the term of this patent is extended or adjusted under 35 U.S.C. 154(b) by 55 days.

(21) Appl. No.: 14/259,917

(22) Filed: Apr. 23, 2014

(65) Prior Publication Data

US 2015/0308768 A1 Oct. 29, 2015

(51) Int. Cl.
*F41A 11/04* (2006.01)

(52) U.S. Cl.
CPC ..... *F41A 11/04* (2013.01)

(58) Field of Classification Search
CPC ..... F41C 23/04; F41C 23/16
USPC ..... 42/75.03, 108, 106
See application file for complete search history.

(56) References Cited

U.S. PATENT DOCUMENTS

| | | | | |
|---|---|---|---|---|
| 2,958,974 | A | 1/1959 | Sefried, II | |
| 4,358,987 | A | 11/1982 | Wilhelm | |
| 6,513,273 | B2 * | 2/2003 | da Silveira | 42/70.08 |
| 7,726,060 | B1 | 6/2010 | Jones | |
| 7,937,876 | B1 | 5/2011 | Graham | |
| 8,689,478 | B2 * | 4/2014 | Patel | 42/75.02 |
| 9,022,015 | B2 * | 5/2015 | Tseng | 124/51.1 |
| 2002/0020099 | A1 * | 2/2002 | Silveira | 42/70.08 |
| 2010/0229445 | A1 * | 9/2010 | Patel | 42/6 |
| 2013/0019513 | A1 * | 1/2013 | Telles | 42/94 |
| 2013/0055610 | A1 | 3/2013 | Watkins | |
| 2013/0205637 | A1 * | 8/2013 | Patel | 42/75.02 |
| 2013/0263732 | A1 * | 10/2013 | Kucynko | 89/191.01 |
| 2015/0198394 | A1 * | 7/2015 | Hochstrate et al. | 42/17 |

OTHER PUBLICATIONS

Amazon Website; "ar15 takdown pins"; pp. 1-6.
Website: YHM, Yankee Hill Machine Co., Inc.; AR-15 Replacement Parts; pp. 1-3.
Barrel, Handguard and Front Sight Components in This Disassembly Group; AR-15-Type Rifle Exploded Diagram; 1 page.
Website: www.brownells.com; AR-15/M4 Pins; Takedown Parts at Brownells; pp. 1-2.
Website: www.cheaperthandirt.com; Cheaper Than Dirt: America's Ultimate Shooting Sports Discounter; pp. 1-2.
Website: www.jprifles.com; JP Enterprises, Inc. Performance Tactical Gear; JP—Tension Pin; pp. 1-2.
Website: www.riflegear.com; Lower Receiver Parts; pp. 1-8.
Website: www.rapa4.com; M-4 Real Action Marker Analysis; 1 page.
Website: www.joeboboutfitters.com; Pin Kits; pp. 1-4.
Website: www.rainierarms.com; Rainier Arms, Browse, Other Lower Parts, KNS Push Buttons Pivot; 1 page.
Sole Picture of a 2 Rifles; a gun.
Website: www.midwaysusa.com; Takedown Detent Pins (Front & Rear)—AR-15; 1 page.

* cited by examiner

*Primary Examiner* — Benjamin P Lee
(74) *Attorney, Agent, or Firm* — Maier & Maier, PLLC

(57) ABSTRACT

A firearm pin assembly is provided. A firearm pin may have a substantially cylindrical member with a lever on one end and a track running along its side. The track may run helically for a portion of its path. The track may also have at least one dimple disposed within its path. The firearm pin assembly may have an aperture for installing a detent and detent spring. The firearm pin assembly may be used in any firearm, including but not limited to a takedown pin and pivot pin assembly in an AR-15 style rifle.

14 Claims, 6 Drawing Sheets

FIREARM PIN

BACKGROUND

This application relates generally to firearms, and more particularly, to firearms that use pins to couple parts of the firearm.

In at least some known firearms, such as but not limited to AR15 style rifles, different parts of the firearm may be removably connected. For example, in an AR15 style rifle, an upper receiver and a lower receiver may be removably connected by a set of pins. These pins include a takedown pin and a pivot pin. Takedown pins and pivot pins may allow for partial separation and pivoting or full separation of the upper and lower receiver portions. It is necessary to separate the receivers for routine maintenance, cleaning, and repairs of the firearm. Manipulating the takedown and pivot pins is consequently an essential task. Sliding a takedown pin into an open position often involves two hands and the use of a tool. This can make disassembly of the firearm, which is an essential task, difficult and timely for firearm operators. Military, law enforcement personnel, or civilian users may have to field strip a firearm to fix a malfunction without tools readily available and with time as an important factor.

SUMMARY

In one exemplary embodiment, a firearm pin may be provided. A firearm pin may include a substantially cylindrical member with a lever on one end and a track running along its side, with at least one dimple inside the track. The track may start proximate a first end of the substantially cylindrical member and run helically for a distance before running coaxially with the substantially cylindrical member to a point proximate a second end of the substantially cylindrical member.

In another exemplary embodiment, a firearm pin may include a substantially cylindrical member having a first end and a second end, a pin head, a track, at least one dimple, and at least one aperture. The pin head may be attached to the first end of the substantially cylindrical member. The track may begin proximate the first end of the substantially cylindrical member and run to a point proximate the second end of the substantially cylindrical member. The at least one dimple may be disposed within the track. The at least one aperture may allow a detent and detent spring to pass through the substantially cylindrical member, perpendicular to a centerline longitudinal axis, without intersecting the track.

In yet another exemplary embodiment, a firearm pin may include a substantially cylindrical member having a first end and a second end, a pin head, a track and at least one dimple. The pin head may be attached to the first end of the substantially cylindrical member. The track may begin in the pin head and run substantially helically through the first end and along a perimeter of the substantially cylindrical member for a distance from the first end, and then run coaxially with the substantially cylindrical member along its perimeter to a point proximate the second end of the substantially cylindrical member. The at least one dimple may be disposed within the track.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1:
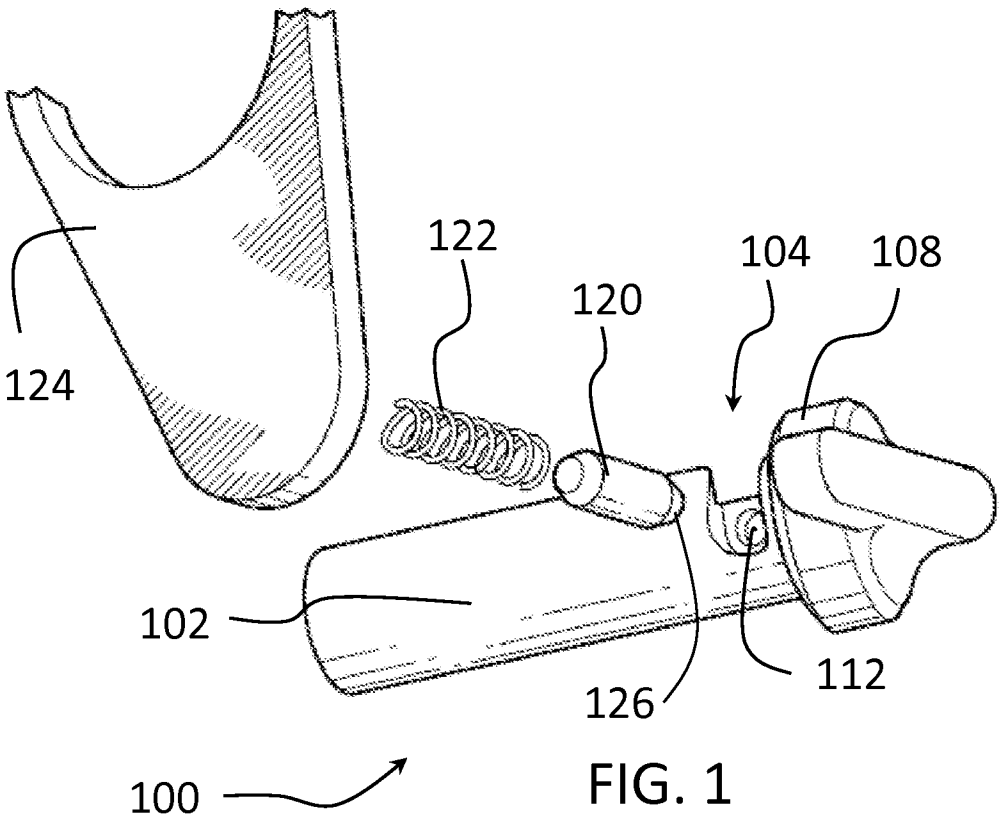
FIG. 1 shows a rear perspective view of an exemplary firearm pin assembly.
Figure 2:
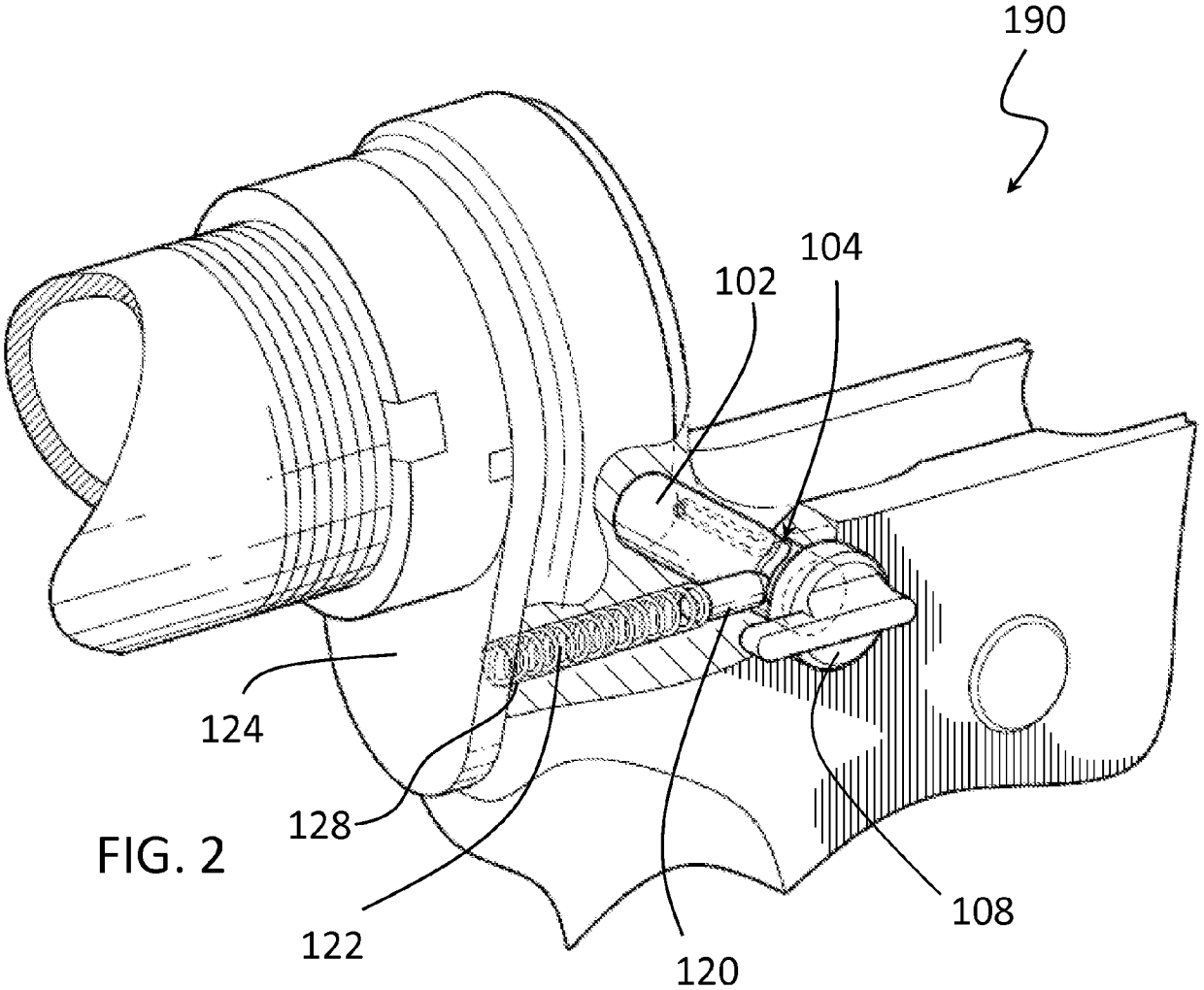
FIG. 2 shows a top right rear perspective view of an exemplary firearm pin assembly.
Figure 3:
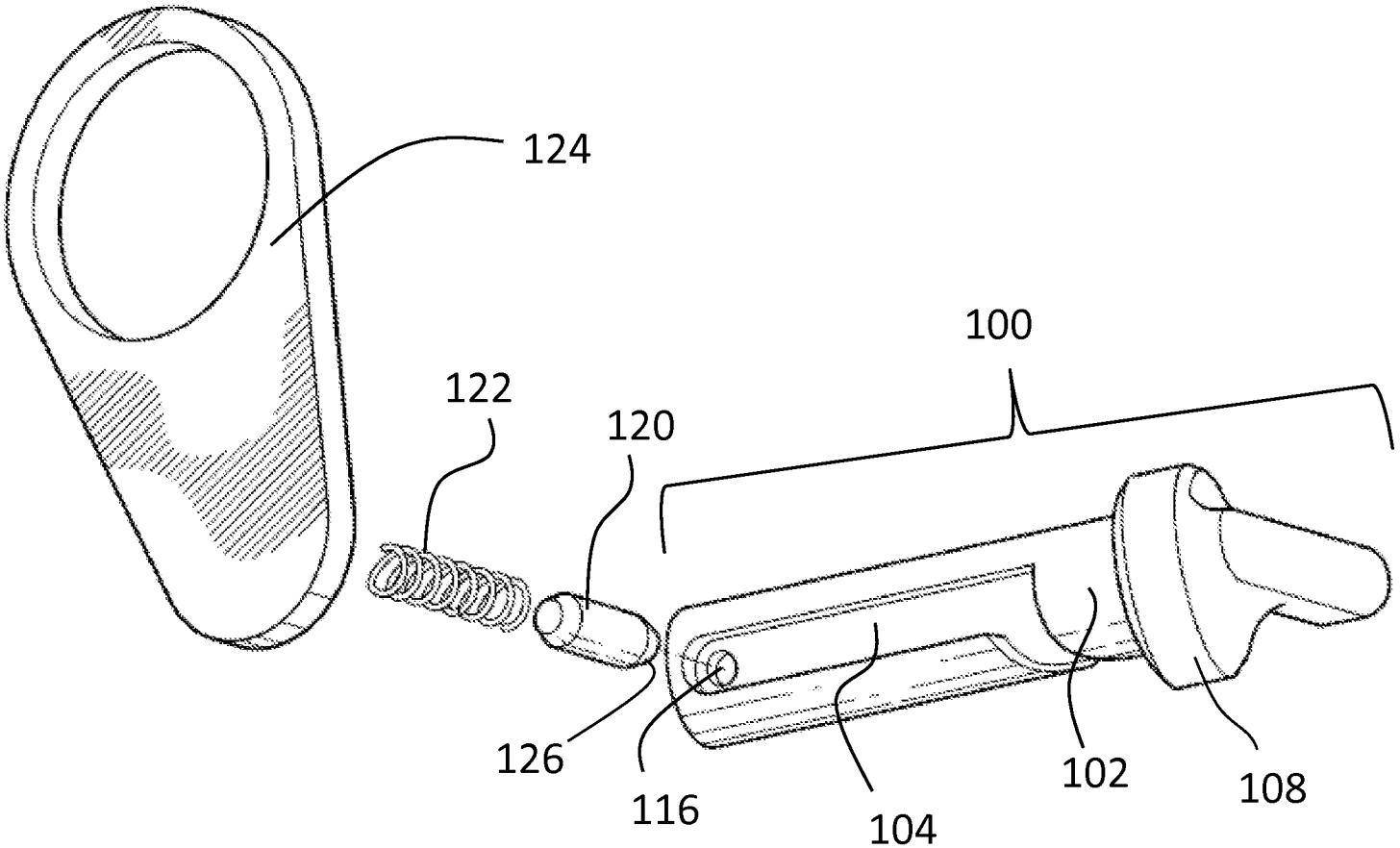
FIG. 3 shows a rear perspective view of an exemplary firearm pin assembly.
Figure 4:
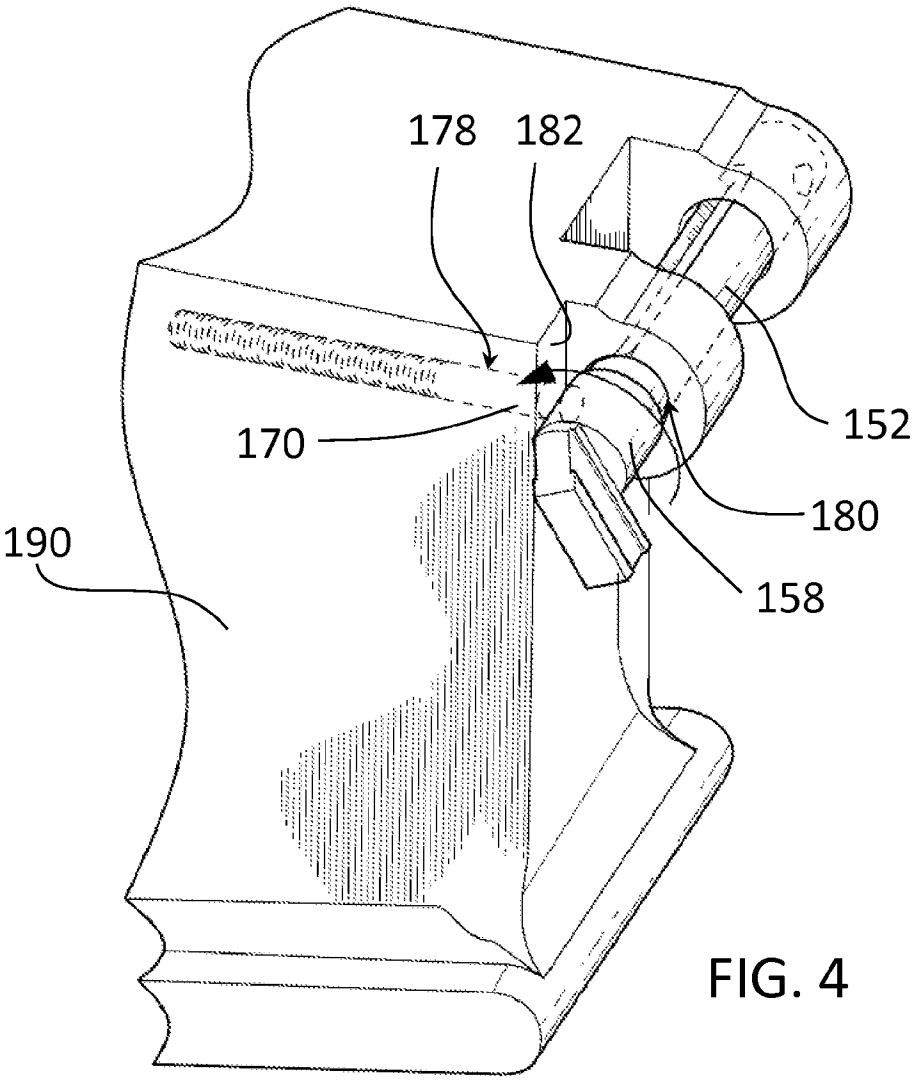
FIG. 4 shows a front perspective view of another exemplary firearm pin assembly.
Figure 5:
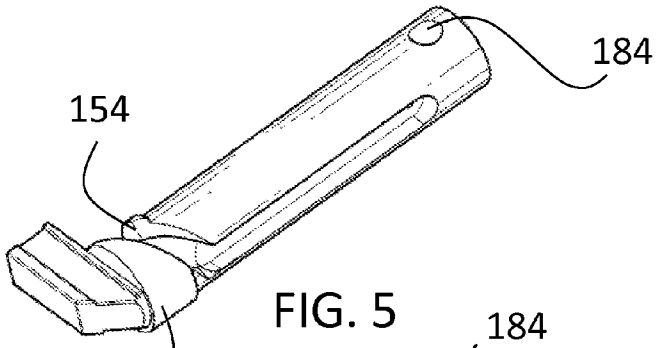
FIG. 5 shows a perspective view of another exemplary firearm pin.
Figure 6:
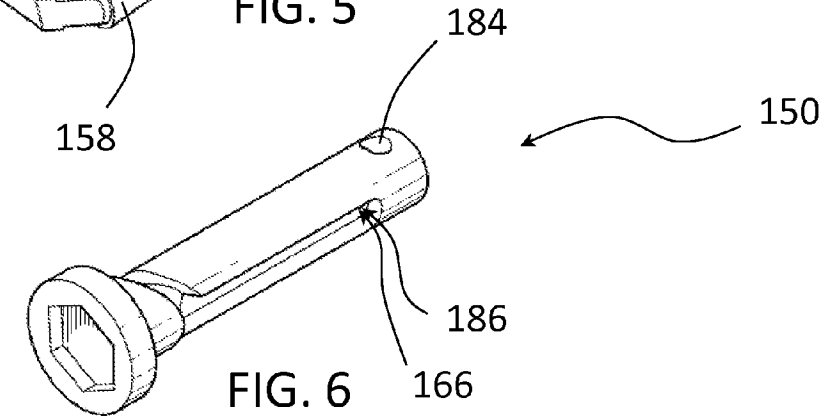
FIG. 6 shows a perspective view of another exemplary firearm pin.
Figure 7:
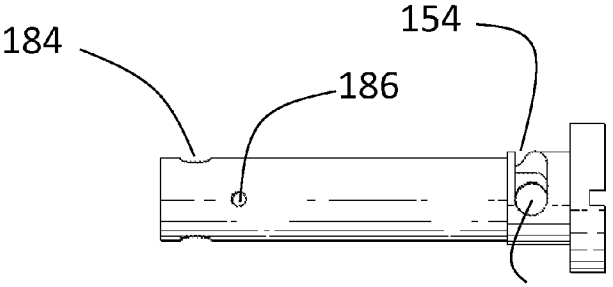
FIG. 7 shows an elevation view of another exemplary firearm pin.
Figure 8:
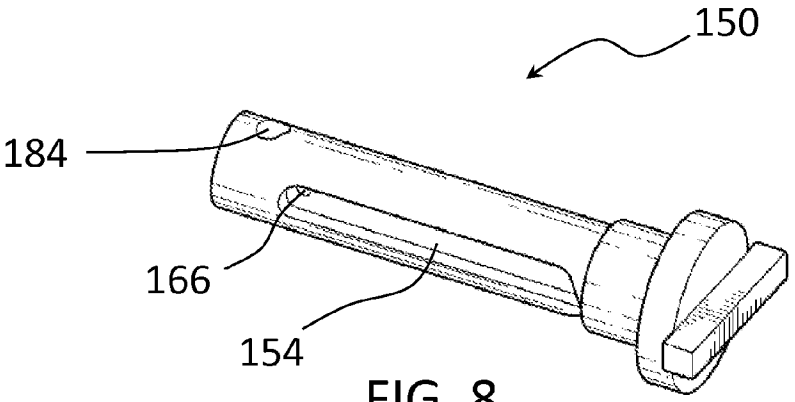
FIG. 8 shows a perspective view of another exemplary firearm pin.
Figure 9:
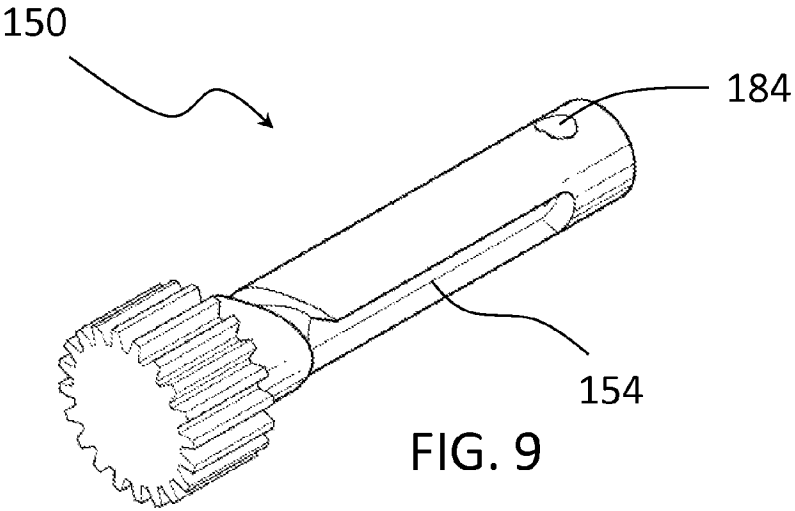
FIG. 9 shows perspective view of another exemplary firearm pin.

FIGS. 1-3 show an exemplary takedown pin 100 embodiment of a firearm pin. Takedown pin 100 may include a substantially cylindrical member 102, a takedown pin head 108, a track 104 and dimples 112, 116. Takedown pin 100 may be used to secure an upper receiver of a firearm to a lower receiver 190 of a firearm. Takedown pin head 108 may be positioned on a first end of substantially cylindrical member 102. Track 104 may start proximate the first end of cylindrical member 102 and travel helically about the circumference of substantially cylindrical member 102 for a portion of its path before travelling straight along a path coaxial to substantially cylindrical member 102. In some embodiments, track 104 may run laterally for an initial portion before travelling helically. Track 104 may end at a point proximate a second end of substantially cylindrical member 102. An exemplary embodiment of a firearm pin assembly may be any length, diameter, size and shape reasonably understood to function as provided by a person having ordinary skill in the art.

In an exemplary embodiment, the helical portion of track 104 may travel at an angle to a longitudinal axis of cylindrical member 102. In some exemplary embodiments, the helical portion of track 104 may travel at approximately a 45 degree angle to the longitudinal axis of cylindrical member 102. Alternatively, the helical portion of track 104 may travel at any angle to the longitudinal axis of cylindrical member 102, as would reasonably be understood by a person having ordinary skill in the art. The helical portion of the track may continue until it has rotated between approximately 65 degrees and approximately 115 degrees about the circumference of cylindrical member 102. In alternative embodiments, the helical portion of the track may continue until it has rotated between approximately 155 degrees and approximately 205 degrees about the circumference of cylindrical member 102. In yet other embodiments, the helical portion may continue for any desired distance of track 104, including the entirety of track 104. In some embodiments, the helical portion may continue for approximately 360 degrees or more about the circumference of the track. In some embodiments where the helical portion extends for the entirety of track 104, the helical portion may continue for greater than 360 degrees about the circumference of cylindrical member 102. The helical portion may be configured differently as required by different firearms or manufacturers.

An exemplary embodiment of a firearm takedown pin 100 may operate as follows. In one exemplary embodiment, a takedown pin 100 may be installed in a rifle, coupling an upper and lower receiver. A user may apply a rotational force to pin 100 through the pin head 108 in order to begin extraction of the takedown pin 100. The force applied to pin head 108 may be strong enough to counter a takedown pin detent spring 122 and dislodge a takedown detent 120 from a first dimple 112 in the takedown pin track 104. This may allow the takedown pin 100 to move as permitted by the detent 120, which may remain engaged in the takedown pin track 104. As the take down pin 100 rotates from the force of the user, it may extract from a takedown pin receiving cavity as the detent 120 moves through the helical portion of track 104.

Detent 120 may be substantially cylindrical and may have a tapered, beveled, or rounded end 126 for engaging takedown pin 100, as would be reasonably understood by a person having ordinary skill in the art. The tapered, beveled, or rounded nature of end 126 may allow detent 120 to engage and disengage from a dimple when enough pressure is applied. An exemplary detent 120 may be symmetrical, such that both ends are tapered or rounded. Take down pin 100 may be configured to work with a variety of detent 120 shapes and sizes. An outer diameter of detent 120 may be smaller than the width of track 104. The first and second dimples 112, 116 may be configured to receive the end 126 of detent 120, such that the detent 120 may engage the dimple, requiring the application of force to move the detent 120 from the dimple 112, 116. Detent 120 and detent spring may both have outer diameters smaller than a diameter of a detent receiving cavity 128.

Once takedown pin 100 has rotated a sufficient amount, the detent 120 may have reached the end of the helical portion of the takedown pin track 104. Takedown pin 100 may then be extracted the remainder of the way by pulling straight out, allowing the detent 120 to travel through the straight portion of the takedown pin track 104. Once the takedown pin 100 is in an extracted position, the detent 120 may engage a second dimple 116 in the takedown pin track 104, securing it in the extracted position until enough pressure is again applied to override the pressure from the takedown pin detent spring 122. The detent spring 122 may be held in a compressed state between the detent 120 engaged with the takedown pin 100 and a receiver plate 124. An upper and lower receiver may be separated at the takedown pin location when the pin is in an extracted position.

Takedown pin 100 may have a variety of pin head 108 configurations. In some exemplary embodiments, the pin head may have a lever disposed thereon. The lever may be substantially symmetrical, or may extend substantially further in one direction past a perimeter of pin 100. Force applied to pin head 108 may counter the takedown pin detent spring 122 and disengage the takedown detent 120 from a dimple 112, 116 in the takedown pin track 104. In other embodiments, the pin head 108 may have a knob, such as a cogged knob, disposed thereon. Alternatively the head 108 may be configured to allow use of a screw driver or Allen wrench. Pin head 108 may be configured in a variety of other ways that permits the application of rotational force, as would reasonably be understood by a person having ordinary skill in the art.

In some exemplary embodiments, a firearm pin device may be shaped to work in different pin locations. For example, a firearm pin may be shaped to work in a pivot pin receiving cavity of an AR-15 or AR-10 style rifle. This alternative embodiment is exemplary and a firearm pin device may be specially shaped to work in a variety of pin receiving cavities, as would be reasonably understood by a person having ordinary skill in the art.

A pivot pin 150 embodiment may be shown in exemplary FIGS. 4-9. In an exemplary embodiment, pivot pin 150 may be configured substantially similarly to takedown pin 100. In some embodiments, pivot pin 150 and takedown pin 100 may be the same or different sizes, such as length or diameter. Pivot pin 150 may include a substantially cylindrical member 152, a pin head 158, a track 154, and dimples 162, 166. Pivot pin 150 may be used to secure an upper receiver of a firearm to a lower receiver of a firearm. Pivot pin head 158 may be positioned on a first end of substantially cylindrical member 152. In an exemplary embodiment, track 154 may start in pin head 158 and progress through the first end of cylindrical member 152. Track 154 may travel helically about the circumference of pin head 158 and substantially cylindrical member 152 for a portion of its path before travelling straight along a path coaxial to substantially cylindrical member 152. In some embodiments, track 104 may run laterally for an initial portion before travelling helically. Alternative to starting in pin head 158, track 154 may start proximate the first end of cylindrical member 152. Track 154 may end at a point proximate a second end of substantially cylindrical member 152.

In an exemplary embodiment, the helical portion of track 154 may travel at an angle to a longitudinal axis of cylindrical member 152. In some exemplary embodiments, the helical portion of track 154 may travel at approximately a 45 degree angle to the longitudinal axis of cylindrical member 152. Alternatively, the helical portion of track 154 may travel at any angle to the longitudinal axis of cylindrical member 152, as would reasonably be understood by a person having ordinary skill in the art. The helical portion of the track may continue until it has rotated between approximately 65 degrees and approximately 115 degrees about the circumference of cylindrical member 152. In alternative embodiments, the helical portion of the track may continue until it has rotated between approximately 155 degrees and approximately 205 degrees about the circumference of cylindrical member 152. In yet other embodiments, the helical portion may continue for any desired distance of track 154, including the entirety of track 154. In some embodiments, the helical portion may continue for approximately 360 degrees or more about the circumference of the track. In some embodiments where the helical portion extends for the entirety of track 154, the helical portion may continue for greater than 360 degrees about the circumference of cylindrical member 152. The helical portion may be configured differently as required by different firearms or manufacturers.

An exemplary embodiment of pivot pin 150 may be configured substantially similar to takedown pin 100 and may operate substantially similarly to takedown pin 100. In some exemplary embodiments, pivot pin head 158 may be approximately the same diameter as cylindrical portion 152. In an exemplary embodiment, pin head 158 may be slightly larger in diameter than cylindrical portion 152. As would be reasonably understood by a person having ordinary skill in the art, pin head 158 may have a diameter slightly larger than cylindrical portion 152 to prevent pin head 158 from entering a pivot pin receiving slot 180 in a firearm receiver, but small enough to fully insert adjacent a receiver portion 182 abutting a pivot pin receiving slot 180. The diameter approximately the same size as cylindrical portion 152 may allow pivot pin 150 to work in firearms where the pin receiving hole is recessed, or where parts of the firearm are disposed proximate the pin location. Additionally, this may allow for track 154 to be disposed such that it travels into pin head 158. This may be necessary in firearm embodiments having a pivot pin detent and detent spring receiving cavity 178 disposed outside of a pivot pin receiving slot 180 in the firearm receiver. The firearm receiver may have a portion 182 housing the detent receiving cavity adjacent the location of pin head 158, when pin 150 is in a fully inserted position. A large diameter pin head 158 may be prevented from fully inserting in the pin receiving slot 180 due to the abutting portion 182 of the receiver housing the detent and detent spring. Having track 154 disposed in pin head 158 may also allow pin 150 to be fully inserted when a detent 170 is engaged in track 154. Pin head 158 may have extensions disposed thereon, such as a lever portion. This may assist in applying rotational pressure to pin 150. The additional members may be configured such that they are disposed beyond any portions of a firearm receiver adjacent pin head 158.

A firearm pin may additionally have a detent installation aperture 184 disposed therein. Detent installation aperture 184 may allow for installation of a detent 170 and detent spring when pin 150 is inserted in a pin receiving slot. The detent spring and detent may be inserted through the pin. An object may then be used to depress the detent and spring within the detent cavity 178 such that the detent and spring are fully removed from the installation aperture 184, and subsequently the orientation of the pin 150 may be adjusted to lock the detent spring and detent within a detent cavity 178. The orientation of the pin may be adjusted until the detent becomes engaged with track 154. In some exemplary embodiments, there may be a detent disengagement aperture 186 disposed in the firearm pin. Detent disengagement aperture 186 may allow an object to protrude through the pin, depressing the detent and detent spring, such that it may be removed from track 154 and the orientation of the pin may be adjusted so that the pin can be moved without the detent engaging the track 154. This may assist in removing the pin from the firearm entirely.

The head portion of a firearm pin 100, 150 or an extension thereof may be configured or shaped a variety of ways to function with different firearms. Exemplary pin head extension configurations may be seen in FIGS. 1-9.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A firearm pin device comprising:

a substantially cylindrical member having a first end and a second end, a pin head, a track and at least one dimple;

wherein the pin head is attached to the first end of the substantially cylindrical member;

the track begins proximate the first end of the substantially cylindrical member, runs substantially helically along a perimeter of the substantially cylindrical member for a distance from the first end, and then runs coaxially with the substantially cylindrical member along its perimeter to a point proximate the second end of the substantially cylindrical member; and the at least one dimple is disposed within the track.

2. The device of claim 1, wherein the helical portion of the track travels between approximately 65 degrees and approximately 115 degrees about the circumference of the substantially cylindrical member.

3. The device of claim 1, wherein the helical portion of the track travels between approximately 155 degrees and approximately 205 degrees about the circumference of the substantially cylindrical member.

4. The device of claim 1, wherein the at least one dimple is disposed on the bottom surface of said track.

5. The device of claim 1, wherein a first dimple is disposed within the track proximate the first end of the substantially cylindrical member and a second dimple is disposed within the track proximate the second end of the substantially cylindrical member.

6. A firearm pin device comprising:

a substantially cylindrical member having a first end and a second end, a pin head, a track, at least one dimple, and at least one aperture;

wherein the pin head is attached to the first end of the substantially cylindrical member;

the track begins proximate the first end of the substantially cylindrical member and runs to a point proximate the second end of the substantially cylindrical member;

the at least one dimple is disposed within the track; and the at least one aperture is configured to allow a detent and detent spring to pass through the substantially cylindrical member, perpendicular to a centerline longitudinal axis, without intersecting the track.

7. The firearm pin device of claim 6, wherein the at least one aperture is disposed proximate the second end of the substantially cylindrical member.

8. The firearm pin device of claim 6, further comprising a detent disengagement aperture configured to pass, perpendicularly to the centerline longitudinal axis, through the substantially cylindrical member such that it passes through the track;

wherein the detent disengagement aperture is configured to allow an object to pass through the substantially cylindrical member, apply pressure to a detent, compress a detent spring, and allow the firearm pin device to rotate free from restriction.

9. A firearm pin device comprising:

a substantially cylindrical member having a first end and a second end, a pin head, a track and at least one dimple;

wherein the pin head is attached to the first end of the substantially cylindrical member;

the track begins in the pin head and runs substantially helically through the first end and along a perimeter of the substantially cylindrical member for a distance from the first end, and then runs coaxially with the substantially cylindrical member along its perimeter to a point proximate the second end of the substantially cylindrical member; and the at least one dimple is disposed within the track.

10. The pin device of claim 9, wherein the pin head is approximately the same diameter as the substantially cylindrical portion.

11. The device of claim 9, wherein the helical portion of the track travels between approximately 65 degrees and approximately 115 degrees about the circumference of the substantially cylindrical member.

12. The device of claim 9, wherein the helical portion of the track travels between approximately 155 degrees and approximately 205 degrees about the circumference of the substantially cylindrical member.

13. The device of claim 9, wherein the at least one dimple is disposed on the bottom surface of said track.

14. The device of claim 9, wherein a first dimple is disposed within the track proximate the first end of the substantially cylindrical member and a second dimple is disposed within the track proximate the second end of the substantially cylindrical member.

* * * * *